US010694860B2

(12) United States Patent
Jin

(10) Patent No.: US 10,694,860 B2
(45) Date of Patent: Jun. 30, 2020

(54) FOLDABLE BED FRAME

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., Ltd., Xiamen (CN)

( * ) Notice: Subject to any disclaimer, the term of this patent is extended or adjusted under 35 U.S.C. 154(b) by 358 days.

(21) Appl. No.: 15/640,810

(22) Filed: Jul. 3, 2017

(65) Prior Publication Data

US 2018/0000254 A1 Jan. 4, 2018

(51) Int. Cl.
*A47C 19/00* (2006.01)
*A47C 19/12* (2006.01)
*A47C 17/70* (2006.01)

(52) U.S. Cl.
CPC ..... *A47C 19/122* (2013.01); *A47C 17/70* (2013.01)

(58) Field of Classification Search
CPC ..... A47C 19/00; A47C 19/005; A47C 19/02; A47C 19/021; A47C 19/024; A47C 19/025; A47C 19/027; A47C 19/028; A47C 19/04; A47C 19/045; A47C 19/20
See application file for complete search history.

(56) References Cited

U.S. PATENT DOCUMENTS 190,338 A * 5/1877 Hall ..... A47C 19/122 5/179
261,770 A * 7/1882 Segar ..... A47C 19/126 5/116
478,761 A * 7/1892 Rodecap ..... A47C 19/122 5/174
605,126 A 6/1898 Odell
767,680 A * 8/1904 Barton ..... A47C 19/128 5/178
802,390 A * 10/1905 Gusdorf ..... A47C 19/122 5/174
1,070,525 A 8/1913 Pieper
1,196,253 A 8/1916 Lowy
1,218,868 A 3/1917 Jones
1,259,825 A 3/1918 Basile
1,360,983 A 11/1920 Burton
(Continued)

FOREIGN PATENT DOCUMENTS

JP 2005-28000 A 2/2005

OTHER PUBLICATIONS

U.S. Appl. No. 15/144,545, filed May 2, 2016.
(Continued)

*Primary Examiner* — Peter M. Cuomo
*Assistant Examiner* — Ifeolu A Adeboyejo
(74) *Attorney, Agent, or Firm* — Morgan, Lewis & Bockius LLP

(57) ABSTRACT

A foldable bed frame comprising two symmetrically arranged unit bed frames is provided. The two unit bed frames are hinged to each other at their connection. A unit bed frame is further provided with a first plurality of support legs in hinge connection with the unit bed frame. The direction in which the plurality of first support legs fold is perpendicular to the direction in which the unit bed frame folds. Both the folding and unfolding of the foldable bed frame are very simple and convenient, and the volume after folding is small, which facilitates storage and transport.

13 Claims, 12 Drawing Sheets

(56) References Cited

U.S. PATENT DOCUMENTS

| | | | | | |
|---|---|---|---|---|---|
| 1,367,173 | A * | 2/1921 | Berta | A47C 17/66 | 5/111 |
| 1,530,726 | A | 3/1925 | Koenigkramer | | |
| 1,574,659 | A | 2/1926 | Johnston | | |
| 2,513,168 | A | 6/1950 | Gottlieb | | |
| 2,651,787 | A | 9/1953 | Piliero | | |
| 2,671,229 | A | 3/1954 | Vernier | | |
| 2,678,085 | A | 5/1954 | De Minno | | |
| 2,701,603 | A | 2/1955 | Coopersmith | | |
| 2,782,075 | A | 2/1957 | Fagan | | |
| 2,888,688 | A | 6/1959 | Bereman | | |
| 3,108,291 | A * | 10/1963 | Eason | A47C 17/68 | 5/111 |
| 3,245,363 | A | 4/1966 | Kanitz | | |
| 3,295,149 | A | 1/1967 | Hall | | |
| 3,967,330 | A * | 7/1976 | Zawadowsky | A47C 19/122 | 5/114 |
| 4,048,683 | A | 9/1977 | Chen | | |
| 4,594,743 | A * | 6/1986 | Owen | A47C 17/70 | 5/111 |
| 4,620,336 | A | 11/1986 | Miller | | |
| 4,654,905 | A | 4/1987 | Miller | | |
| 5,517,744 | A * | 5/1996 | Moser | B21D 39/044 | 29/525 |
| 5,608,930 | A * | 3/1997 | Chen | A47C 19/122 | 5/174 |
| 5,894,614 | A | 4/1999 | Stroud | | |
| 6,151,730 | A | 11/2000 | Weston | | |
| 6,230,344 | B1 | 5/2001 | Thompson | | |
| 6,643,900 | B2 | 11/2003 | Jahrling | | |
| 7,376,989 | B2 | 5/2008 | Wickstrom | | |
| 7,406,727 | B2 | 8/2008 | Wickstrom | | |
| 7,503,086 | B2 | 3/2009 | Wickstrom | | |
| 8,312,576 | B1 | 11/2012 | Oh | | |
| 8,370,973 | B1 | 2/2013 | Oh | | |
| 8,707,478 | B2 | 4/2014 | Jin | | |
| 8,769,740 | B2 | 7/2014 | Oh | | |
| 8,898,832 | B2 | 12/2014 | Oh | | |
| 8,978,176 | B1 * | 3/2015 | Oh | A47C 19/005 | 5/200.1 |
| 9,027,181 | B1 * | 5/2015 | Yu | A47C 17/16 | 5/202 |
| 9,226,590 | B1 | 1/2016 | Hull | | |
| 9,314,386 | B1 * | 4/2016 | Boyd | A61G 7/015 | |
| 9,456,699 | B1 * | 10/2016 | Oh | A47C 19/122 | |
| 9,526,347 | B2 | 12/2016 | Boyd | | |
| 9,538,850 | B2 | 1/2017 | Oh | | |
| 9,907,405 | B2 | 3/2018 | An | | |
| 10,034,551 | B2 | 7/2018 | Hull | | |
| 10,123,629 | B2 | 11/2018 | Choi | | |
| 10,285,506 | B2 | 5/2019 | Choi | | |
| 10,321,767 | B2 | 6/2019 | Jin | | |
| 2003/0039506 | A1 | 2/2003 | Chen | | |
| 2005/0251911 | A1 | 11/2005 | Wickstrom | | |
| 2006/0195982 | A1 | 9/2006 | Cloer | | |
| 2006/0230532 | A1 | 10/2006 | Wickstrom | | |
| 2008/0000024 | A1 | 1/2008 | Peixin | | |
| 2009/0133191 | A1 | 5/2009 | Harrow | | |
| 2009/0293193 | A1 | 12/2009 | Neatherry | | |
| 2010/0115696 | A1 | 5/2010 | Felix, Jr. et al. | | |
| 2010/0235989 | A1 * | 9/2010 | Jin | A47C 19/126 | 5/174 |
| 2010/0299831 | A1 | 12/2010 | Lee | | |
| 2011/0073723 | A1 | 3/2011 | Ashpole | | |
| 2011/0099712 | A1 * | 5/2011 | Jin | A47C 19/122 | 5/174 |
| 2012/0042449 | A1 | 2/2012 | Hull | | |
| 2012/0222216 | A1 | 9/2012 | Jin | | |
| 2012/0246826 | A1 * | 10/2012 | Jin | A47C 19/04 | 5/400 |
| 2013/0067659 | A1 | 3/2013 | Oh | | |
| 2013/0067862 | A1 | 3/2013 | Oh | | |
| 2013/0276229 | A1 | 10/2013 | Hsieh | | |
| 2014/0345044 | A1 * | 11/2014 | Murphy | A47C 17/225 | 5/14 |
| 2015/0143630 | A1 | 5/2015 | Harrow | | |
| 2015/0320225 | A1 | 11/2015 | Boyd | | |
| 2016/0143447 | A1 * | 5/2016 | Hull | A47C 19/12 | 5/202 |
| 2016/0206112 | A1 * | 7/2016 | Oh | A47C 19/126 | |
| 2016/0262547 | A1 | 9/2016 | Jin | | |
| 2016/0281770 | A1 | 9/2016 | Vankoughnett | | |
| 2016/0302582 | A1 | 10/2016 | Oh | | |
| 2016/0302583 | A1 | 10/2016 | Oh | | |
| 2016/0316922 | A1 | 11/2016 | Choi | | |
| 2017/0119166 | A1 | 5/2017 | An | | |
| 2017/0325592 | A1 | 11/2017 | Suh | | |
| 2018/0116412 | A1 | 5/2018 | Jin | | |
| 2019/0045938 | A1 | 2/2019 | Skaggs | | |

OTHER PUBLICATIONS

U.S. Appl. No. 15/144,471, filed May 2, 2016.
U.S. Appl. No. 15/056,150, filed Nov. Feb. 29, 2016.
U.S. Appl. No. 15/820,754, filed Nov. 22, 2017.
U.S. Appl. No. 15/820,848, filed Nov. 22, 2017.
U.S. Appl. No. 15/423,251, filed Feb. 2, 2017.
U.S. Appl. No. 15/663,522, filed Jul. 28, 2017.
U.S. Appl. No. 15/809,161, filed Nov. 10, 2017.

* cited by examiner

FOLDABLE BED FRAME

CROSS-REFERENCE TO RELATED APPLICATION

The present application claims priority to Chinese Application No. 201620691110.1, filed Jul. 4, 2016, the entire contents of which are hereby incorporated by reference herein for all purposes.

TECHNICAL FIELD

The present disclosure relates to a bed frame, and in particular to a foldable bed frame.

BACKGROUND

A foldable bed frame is designed according to the principle that is can be folded and unfolded in a variety of ways, which has advantages of convenient and practical use, and convenient storage, and is particularly suitable for outdoor recreation and recess.

An existing foldable bed frame typically comprises a side support frame, a connection frame, a side frame and a middle frame. For example, Chinese patent no. 201420443185.9 discloses a foldable bed frame, which comprises a side support frame, a connection frame, a side frame and a middle frame, all positions where a transverse support is connected to a transverse connection bar are provided with a fixing and mounting part for the end surface of the transverse connection bar to be detachably snapped inside, the lower end of an inclined bar is movably hinged to a side vertical support, the upper end of the inclined bar is detachably connected to the transverse support, the middle frame is detachably connected to two middle vertical supports, and the side frame is detachably connected to the side vertical support. It is time-consuming and difficult to unfold and fold this foldable bed frame, which is not convenient in use, has a relatively large size after being folded, and is not convenient to store and transport.

The information disclosed in this background section is only for enhancement of understanding of the general background of the invention and should not be taken as an acknowledgement or any form of suggestion that this information forms the prior art already known to a person skilled in the art.

SUMMARY

To solve the above technical problems in the art, the object of the present disclosure is to provide a foldable bed frame. Both the folding and unfolding of the foldable bed frame are very simple and convenient, and the volume after folding is small, which facilitates storage and transport.

The present disclosure is implemented through the following technical solution: a foldable bed frame, comprising two symmetrically arranged unit bed frames is provided. The two unit bed frames are hinged to each other at a connection. The unit bed frame is further provided with first support legs in hinge connection with the unit bed frame, and the direction in which the first support legs fold is perpendicular to the direction in which the unit bed frame folds.

Preferably, the unit bed frame comprises a first bed frame body and a second bed frame body. The first bed frame body and the second bed frame body are hinged to each other. The first support legs are disposed on the first bed frame body. The first support legs are hinged to the first bed frame body.

Preferably, the first support leg comprises a first support bar, a second support bar, connection pieces and support pieces. The connection pieces are symmetrically arranged on the left edge and the right edge of the inner side of the first bed frame body. The first support bar and the second support bar are each hinged to the connection pieces. One end of the support piece is connected to the connection piece. The other end thereof is connected to the support bar. A connection bar is further disposed between the first support bar and the second support bar.

In some embodiments, the support bar is provided with a boss, the support piece is provided with a slide groove, and the boss can be snapped into the slide groove and slide inside the slide groove.

In some embodiments, the support piece is provided with a boss, the support bar is provided with a slide groove, and the boss can be snapped into the slide groove and slide inside the slide groove.

Preferably, when the support bar is folded, the top surface and the bottom surface of the support bar do not go beyond the top surface and the bottom surface of the first bed frame body.

Compared with the prior art, the present utility model has the following advantages: the present utility model provides a foldable bed frame, which includes two frame bodies 100 and two frame bodies 110, and when folded, all folded support legs are retracted inside the bed frame, such that the overall folded bed frame takes up a small volume to facilitate storage and transport.

Figure 1:
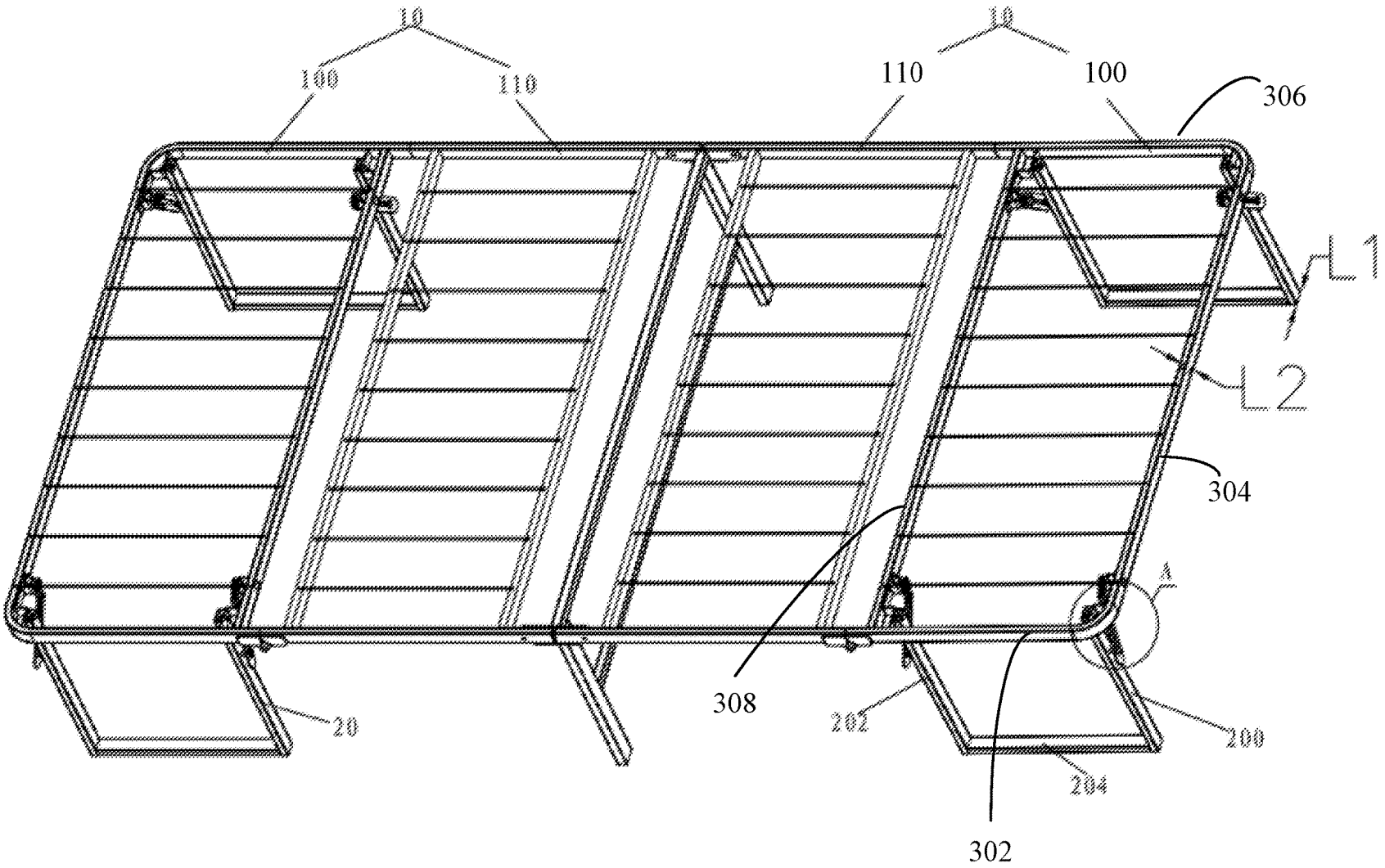
FIG. 1 is a schematic diagram of a foldable bed frame in accordance with a first embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawing and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the present invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

The terminology used in the present disclosure is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and or "comprising," when used in this specification, specify the presence of stated features, integers, steps, operations, elements, and or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

In the description of details below, part legends will be marked in the accompanying drawings and become a part thereof, and moreover, they will be presented through description of a specific example capable of implementing said embodiment. This type of embodiment will provide sufficient details such that those skilled in the art will be able to implement the same. Readers must understand that other embodiments may also be used in the present utility model, or structural, logical and electrical changes may be made without departing from the embodiments. Therefore, the detailed description below may not be construed as a limitation. On the contrary, embodiments comprised therein shall be defined by the claims.

Embodiment 1

Figure 2:
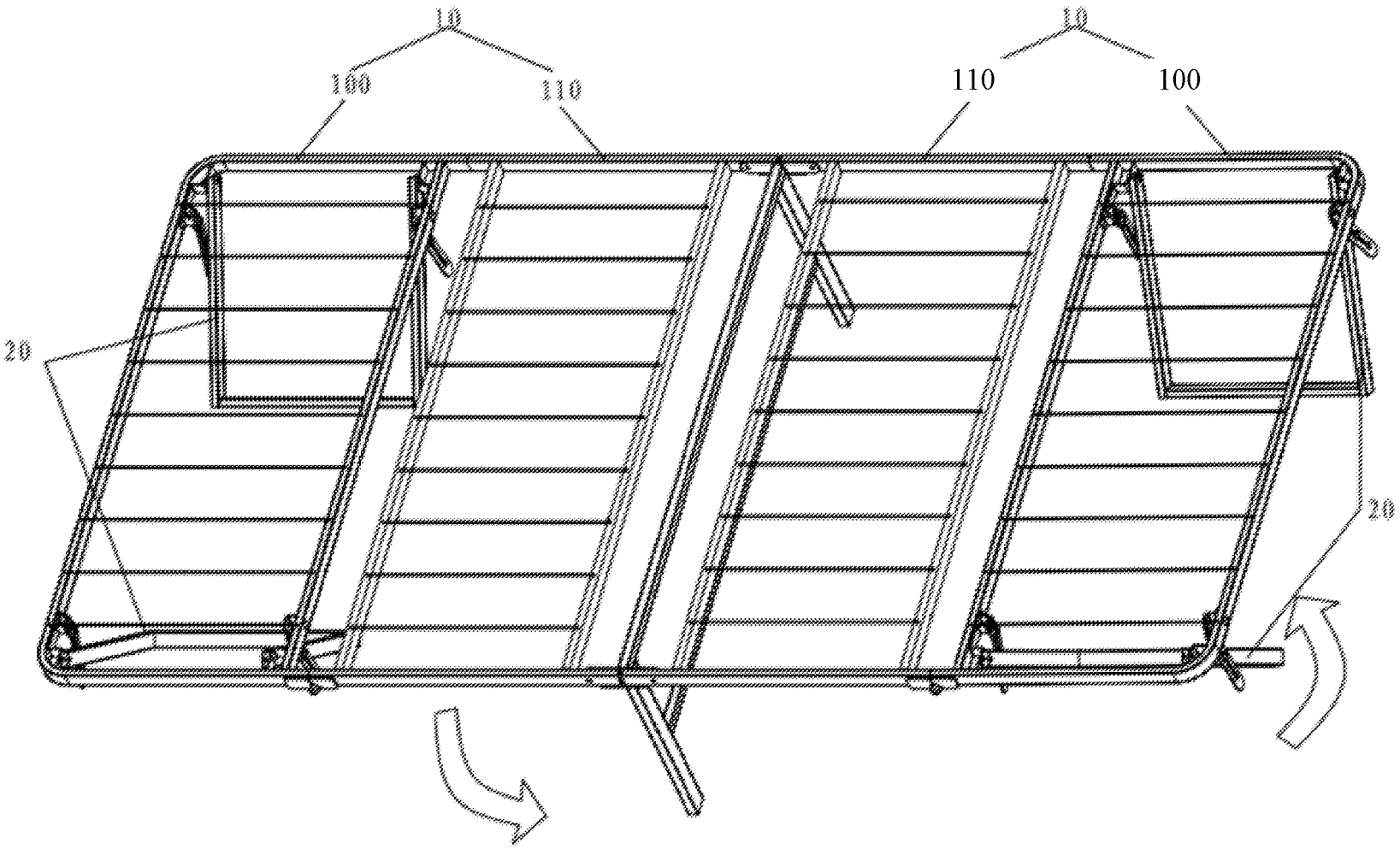
FIG. 2 is a schematic diagram of the folding direction of support legs of the foldable bed frame in accordance with the first embodiment of the present disclosure.
Figure 3:
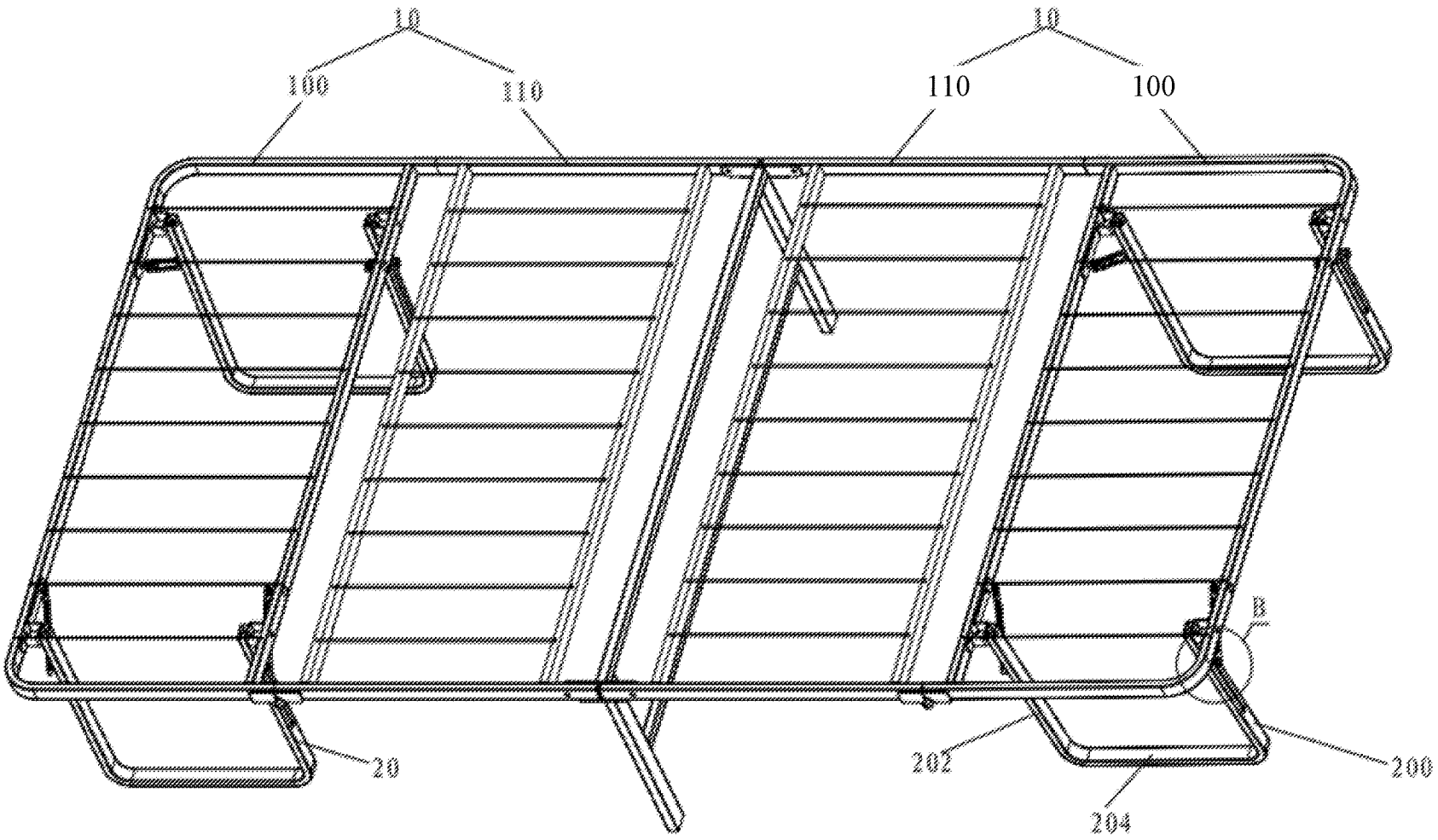
FIG. 3 is a schematic diagram of another implementation of support legs of the foldable bed frame in accordance with the first embodiment of the present disclosure.
Figure 11:
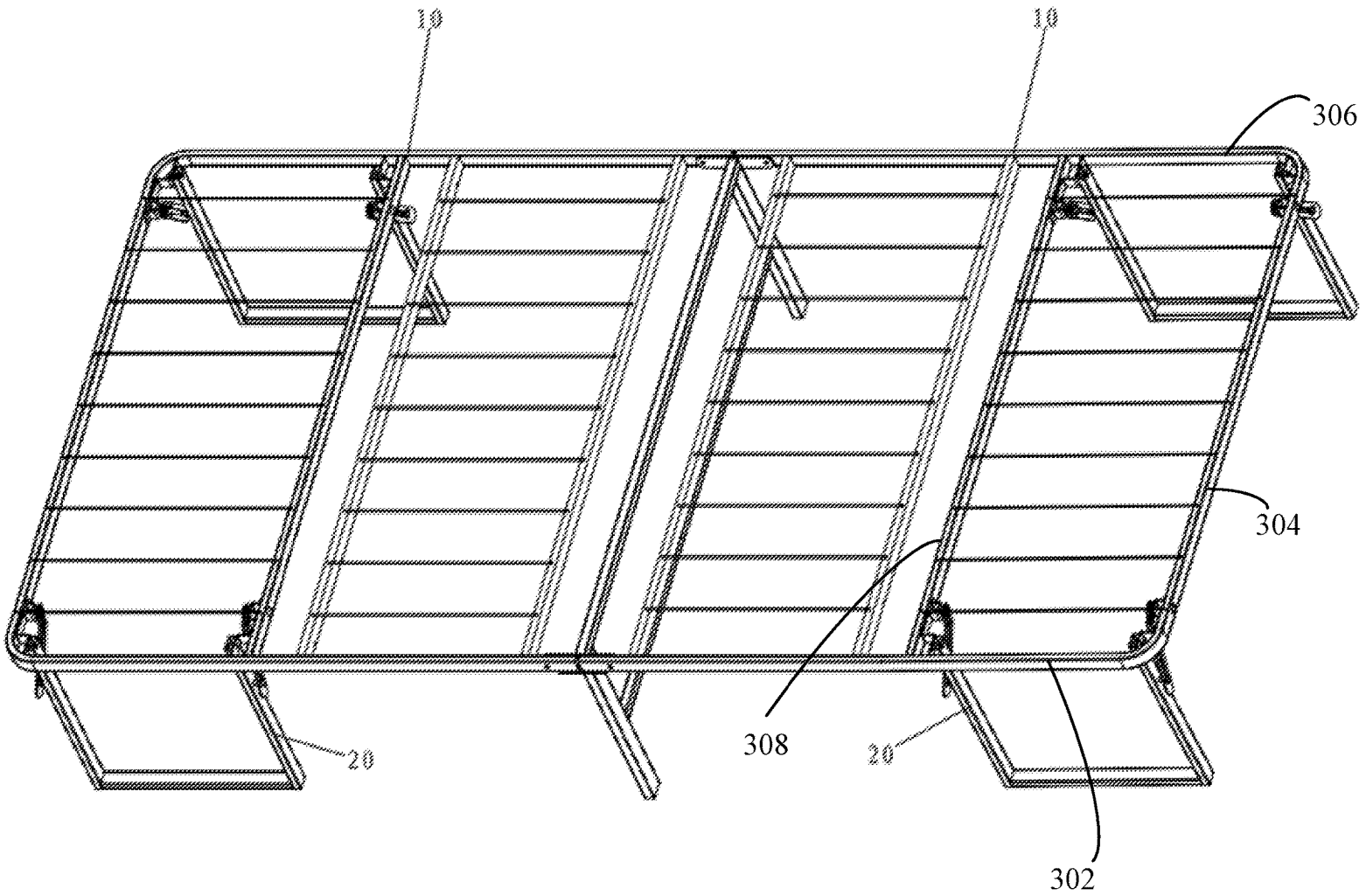
FIG. 11 is a schematic diagram of a foldable bed frame in accordance with a second embodiment of the present disclosure.

As shown in FIG. 1 and FIG. 2, a foldable bed frame comprises two unit bed frames 10 arranged horizontally. The two unit bed frames are hinged to each other at their connection. As illustrated in FIG. 1, each unit bed frame 10 comprises a first bed frame body 100 and a second bed frame body 110. The first bed frame body 100 and the second bed frame body 110 are hinged to each other. Also, first support legs 20 are disposed on the first bed frame body. These first support legs 20 are hinged to the first bed frame body 100. Referring to FIG. 2 and FIG. 6 to FIG. 12, the first support legs 20 can be folded in a direction that is different from the direction in which the foldable bed frame or the unit bed frame folds. In some embodiments, the direction in which the first support legs fold is substantially perpendicular to the direction in which the foldable bed frame or the unit bed frame folds. Referring to FIGS. 1 and 11, in some embodiments, each unit bed frame 10 includes a generally U-shaped exterior frame comprising a first longitudinal bar 302, a second longitudinal bar 306, and an exterior lateral bar 304 in between the first and second longitudinal bars and connected with or formed with the first and second longitudinal bars. Each unit bed frame 10 also includes an interior lateral bar 308 spaced apart from the exterior lateral bar 304. The interior lateral bar 308 has a first end coupled with the first longitudinal bar 302 and a second end coupled with the second longitudinal bar 306. In some embodiments such as that illustrated in FIG. 1, the first longitudinal bar 302, the exterior lateral bar 304, the second longitudinal bar 306, and the interior lateral bar 308 forms at least a part of the first bed frame body 100.

Referring to FIG. 1 to FIG. 5, the first support leg 20 comprises a first support bar 200, and a second support bar 202. The upper end of the first support 200 is pivotally connected with the exterior lateral bar 304 at a side facing the interior lateral bar 308. The upper end of the second support bar 202 is pivotally connected with the interior lateral bar 308 at a side facing the exterior lateral bar 304. In some embodiments, for connecting with the exterior and interior lateral bars, the first support leg 20 comprises connection pieces 210 symmetrically arranged on the exterior and interior lateral bars of the first bed frame body 100 or the unit bed frame 10. The first support bar 200 and the second support bar 202 are each hinged to these two connection pieces 210. In some embodiment, the first support leg 20 comprises a support piece 220. One end of the support piece 220 is connected to the exterior lateral bar 304 or the connection piece 210 at the exterior lateral bar 304, and the other end thereof is connected to the first support bar 200. In some embodiments, the first support leg 20 comprises another support piece 220, one end of which is connected to the interior lateral bar 308 or the connection piece 210 at the interior lateral bar 308, and the other end thereof is connected to the second support bar 202. In some embodiments, the first support leg 20 further comprises a connection bar 204 disposed between the first support bar 200 and the second support bar 202 and connected or formed with the first support bar 200 and the second support bar 202.

In some embodiments, the connection bar 204 is disposed between the lower ends of the first and second support bars.

Figure 4:
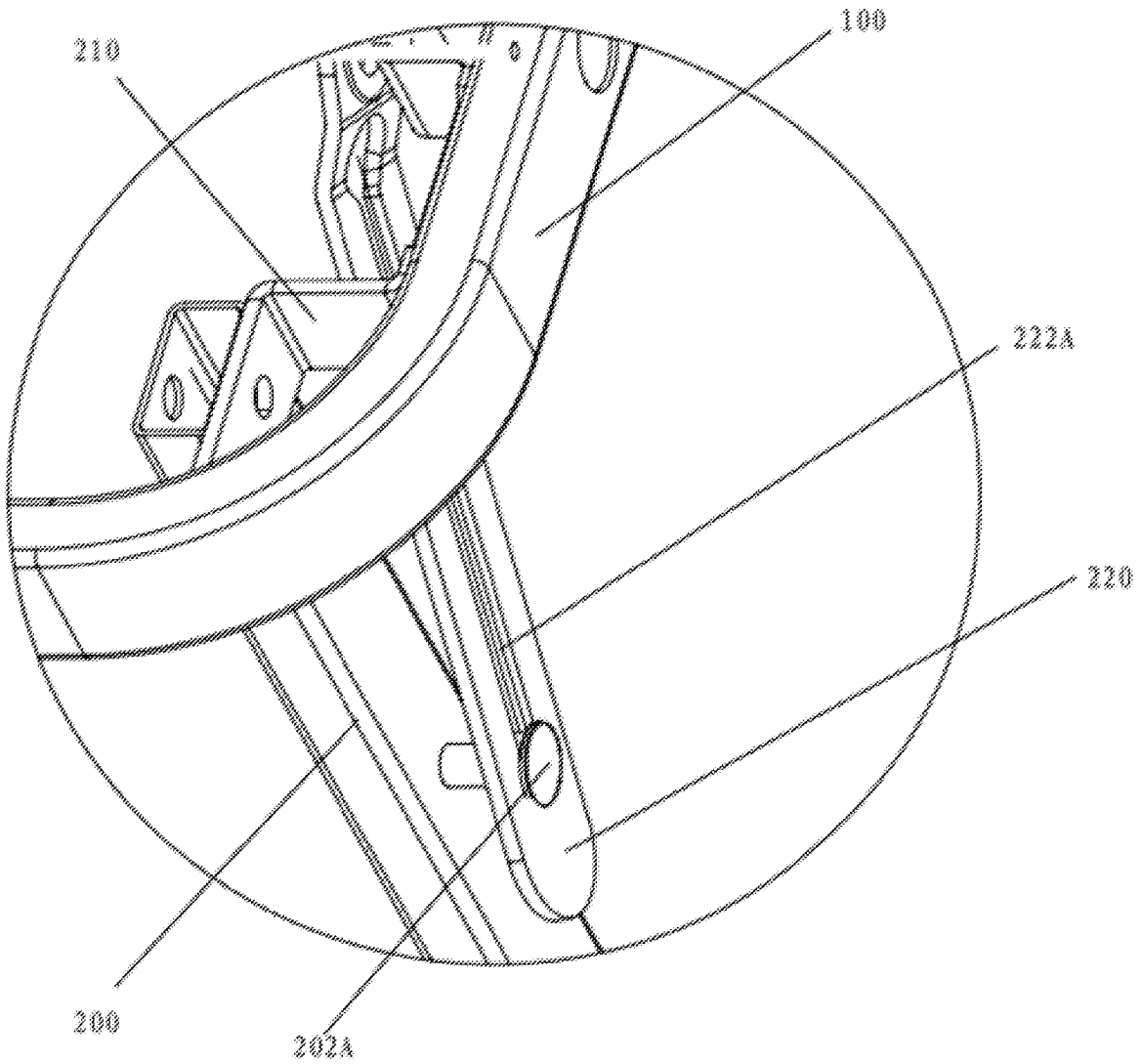
FIG. 4 is an enlarged view of Part A in FIG. 1.

Referring to FIG. 4, the support bar 200 is provided with a boss 202A, the support piece 220 is provided with a slide groove 222A, and the boss 202A can be snapped into the slide groove 222A and slide inside the slide groove 222A. When the support bar 200 is unfolded, the boss 202A is snapped into the groove at one end of the slide groove 222A, such that the support bar 200, the support piece 220, and the connection piece 210 are fixed as a triangle, and the support bar will not shake, thereby ensuring the stability of the foldable bed frame.

Figure 5:
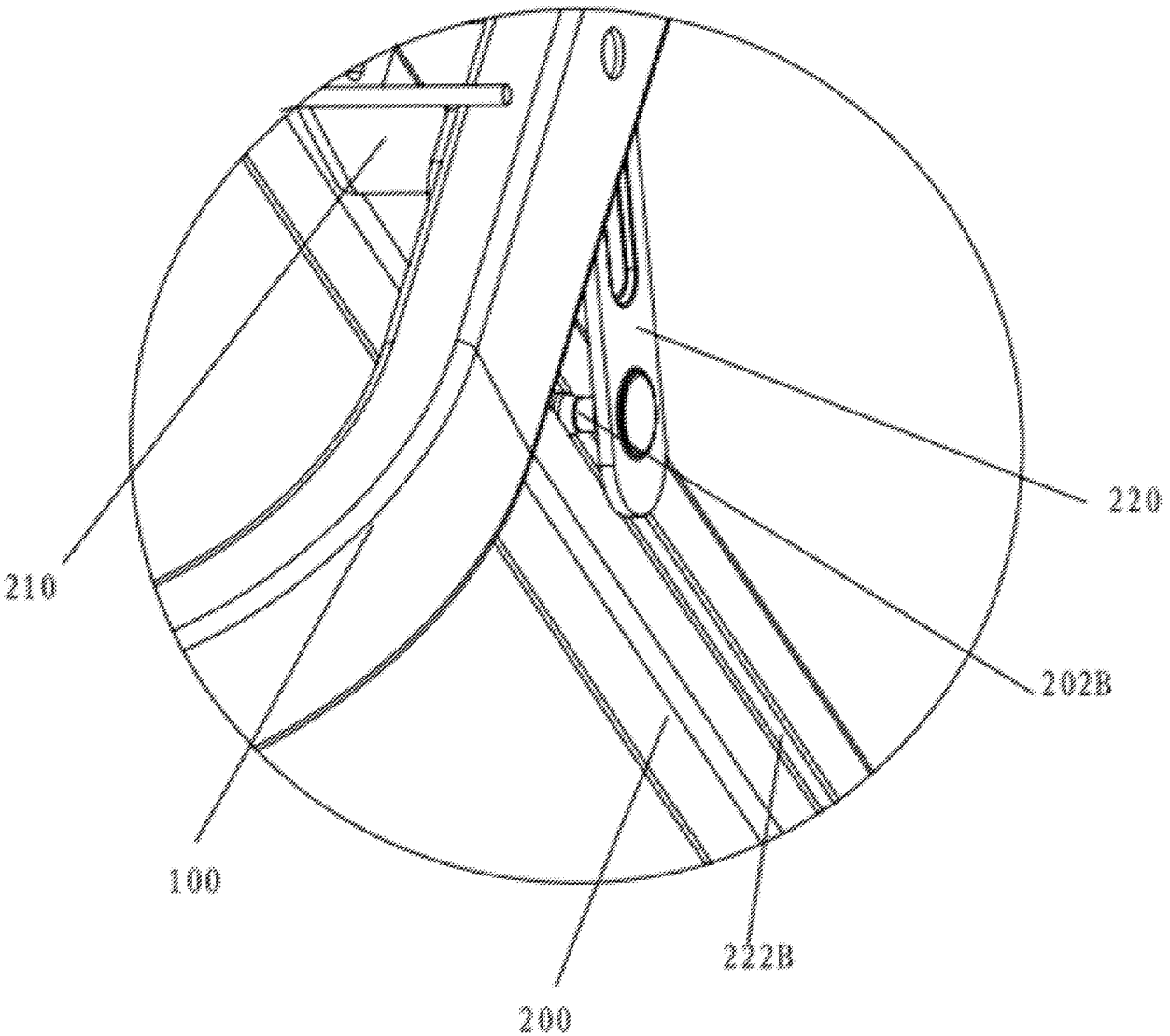
FIG. 5 is an enlarged view of Part B in FIG. 3.
Figure 6:
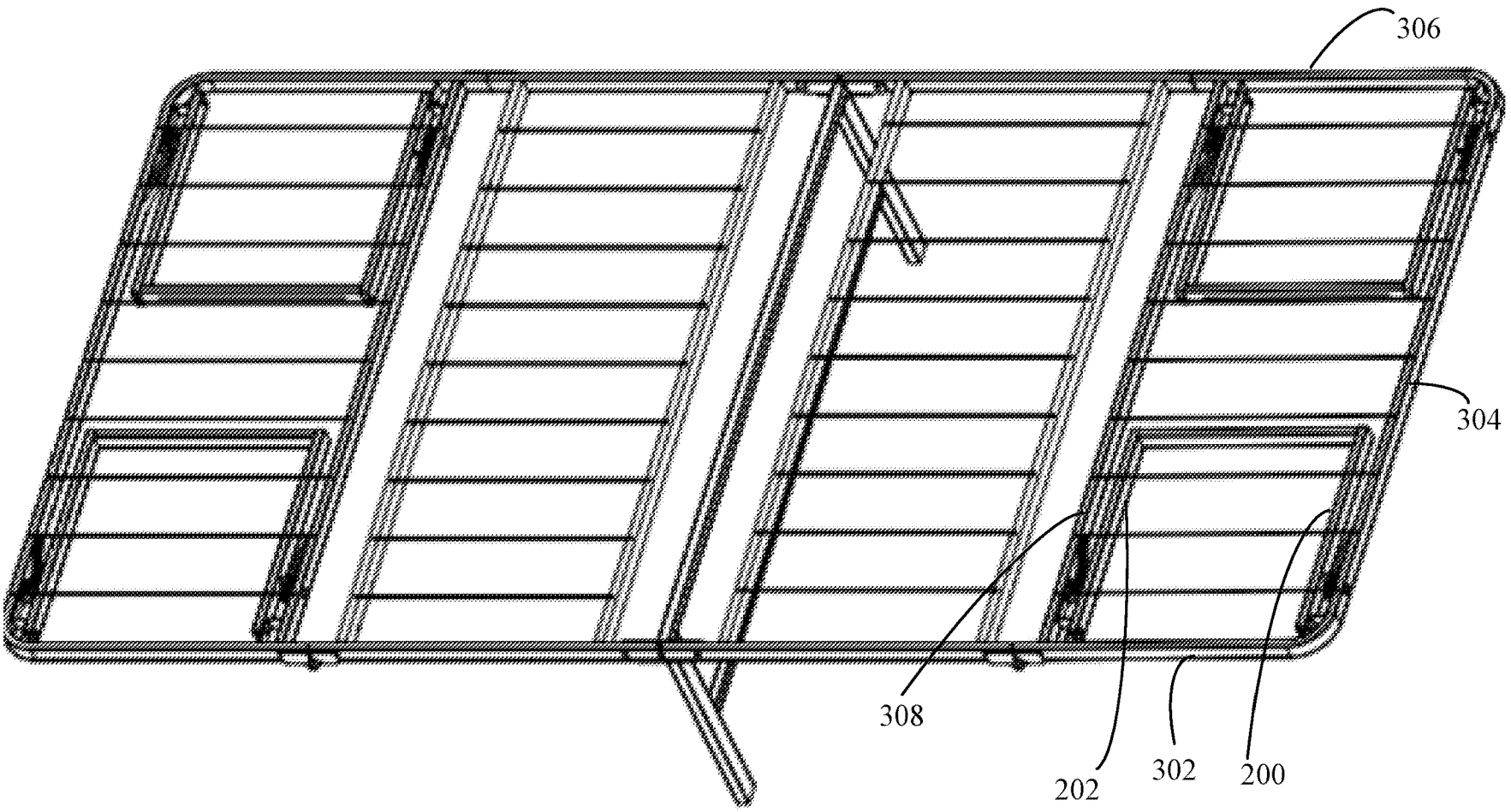
FIG. 6 is a schematic diagram of a folding step of the foldable bed frame in accordance with the first embodiment of the present disclosure.
Figure 7:
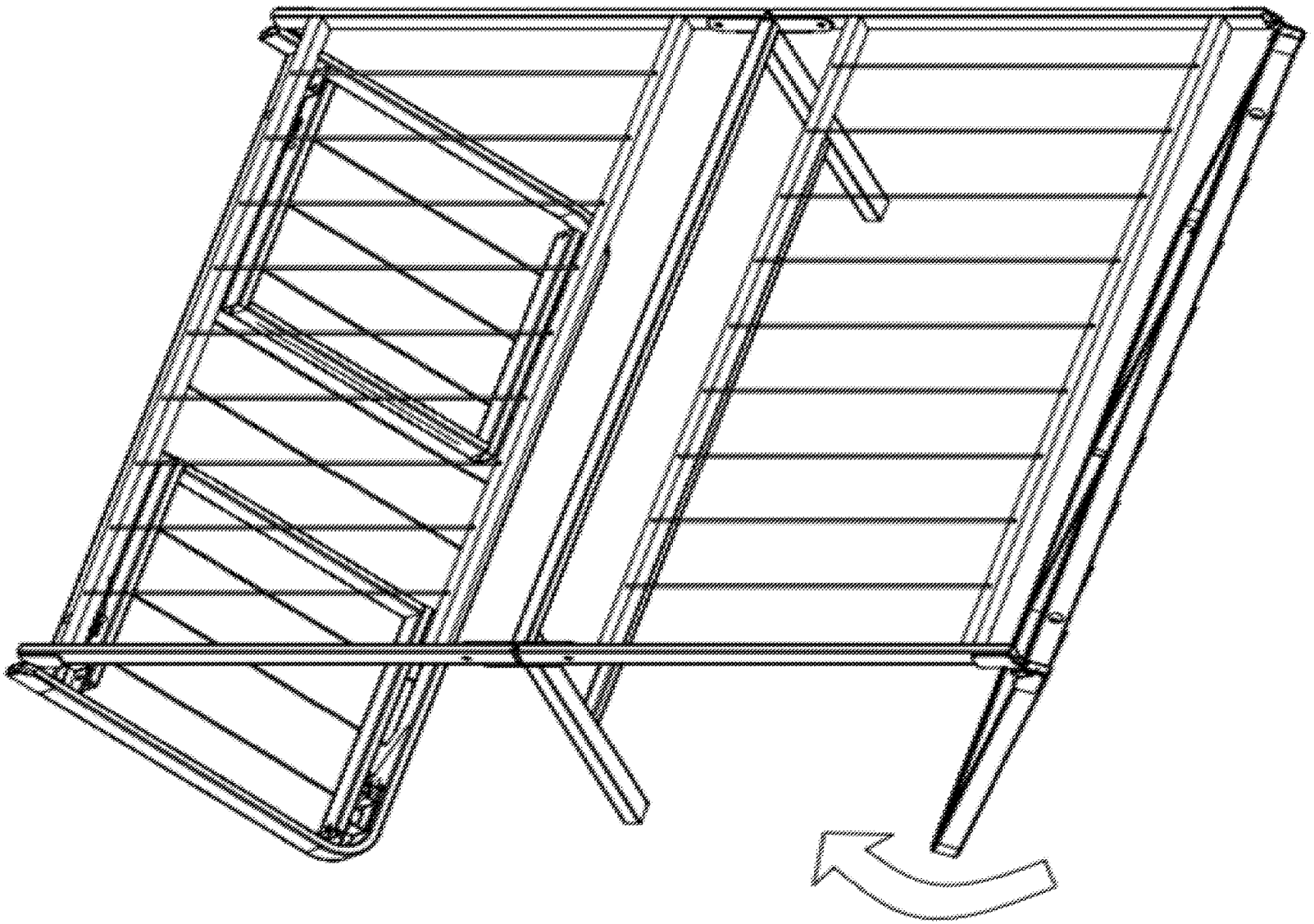
FIG. 7 is a schematic diagram of a folding step of the foldable bed frame in accordance with the first embodiment of the present disclosure.
Figure 8:
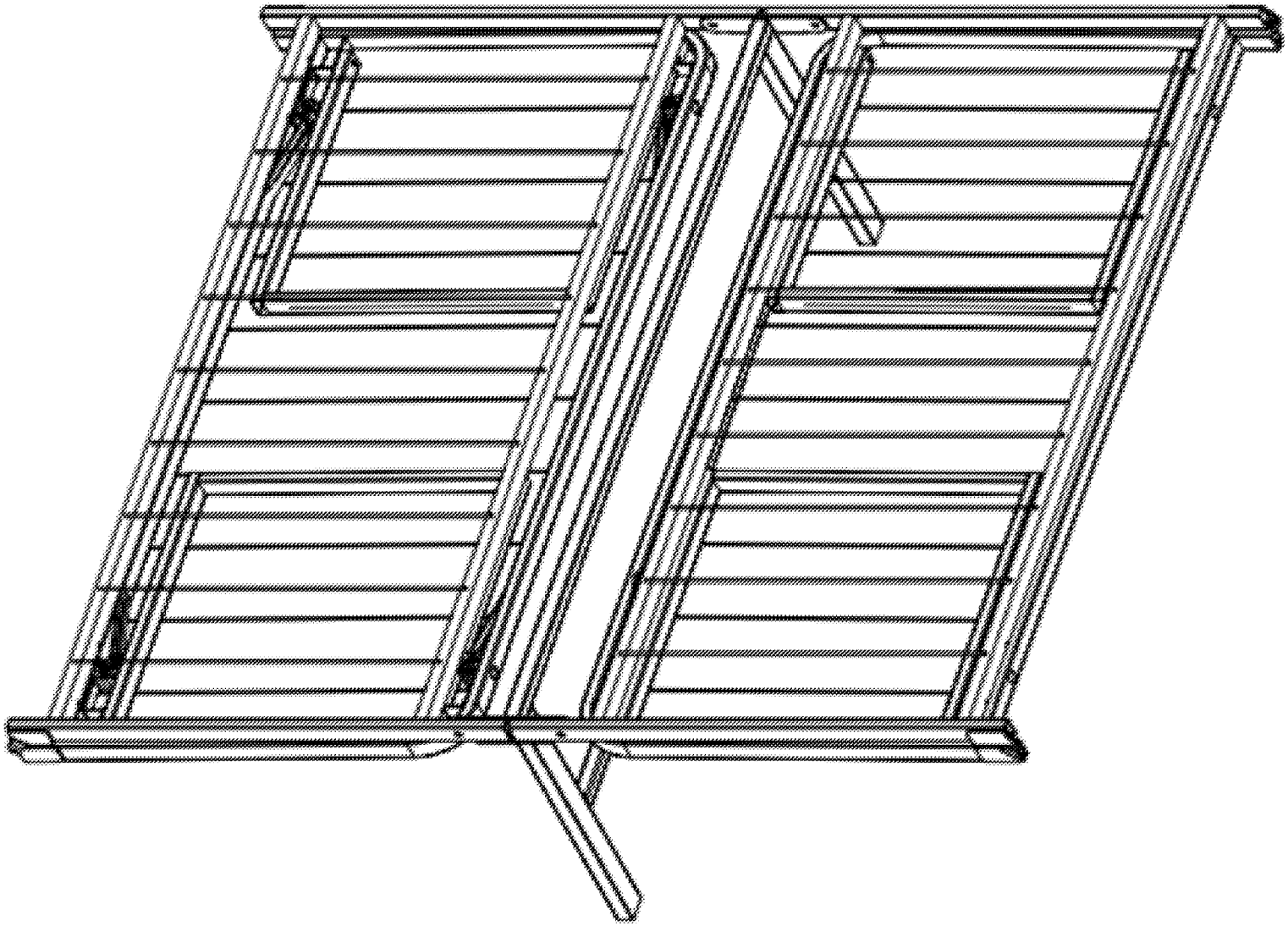
FIG. 8 is a schematic diagram of a folding step of the foldable bed frame in accordance with the first embodiment of the present disclosure.
Figure 9:
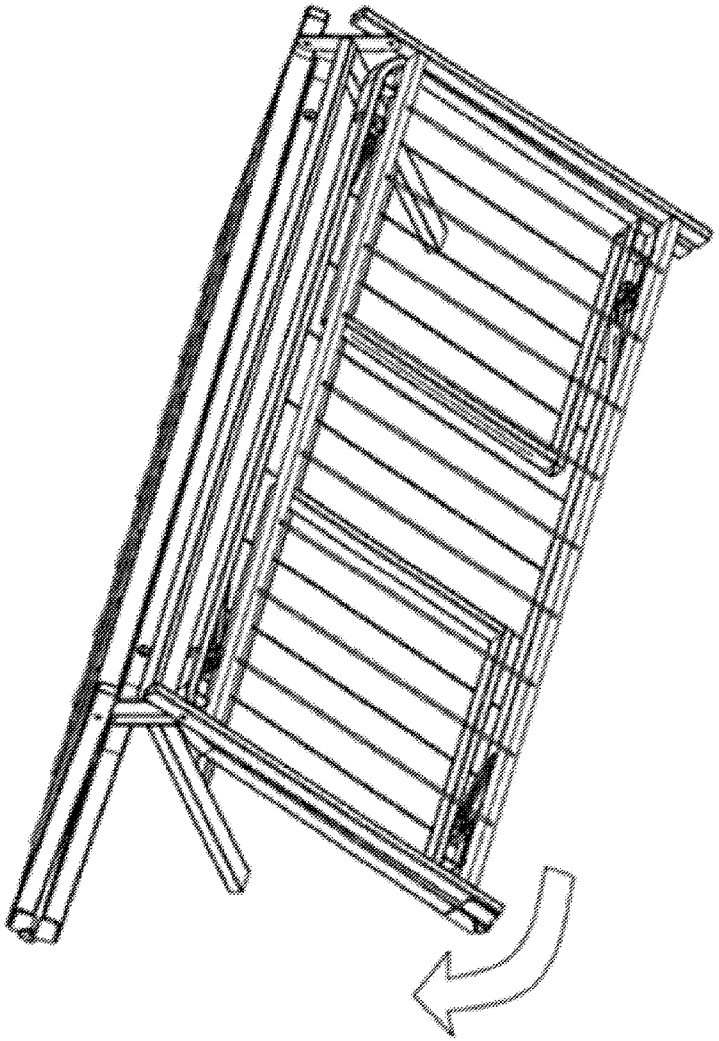
FIG. 9 is a schematic diagram of a folding step of the foldable bed frame in accordance with the first embodiment of the present disclosure.
Figure 10:
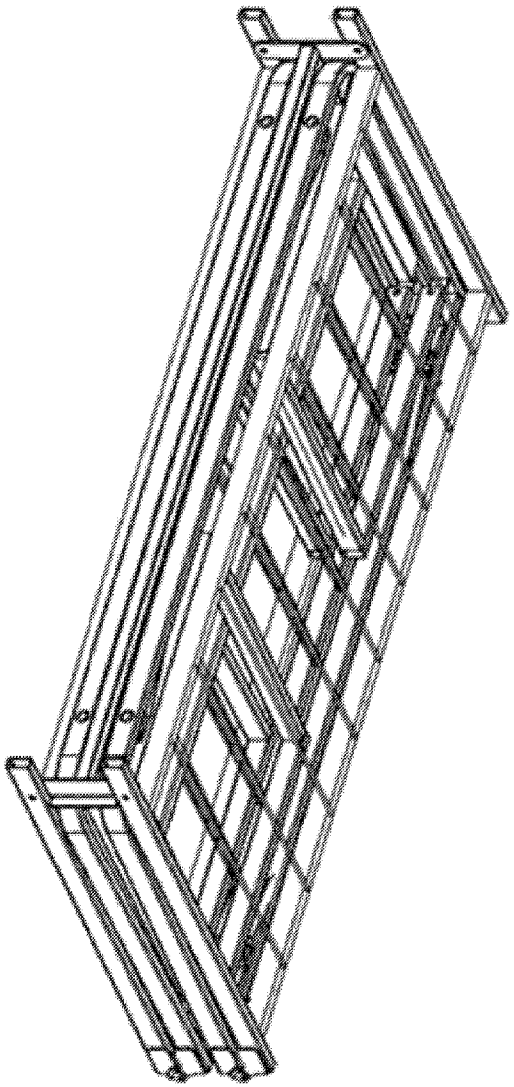
FIG. 10 is a schematic diagram of a folding step of the foldable bed frame in accordance with the first embodiment of the present disclosure.

Referring to FIG. 5, the support piece 220 is provided with a boss 202B, the support bar 200 is provided with a slide groove 222B, and the boss 202B can be snapped into the slide groove 222B and slide inside the slide groove. When the support bar 200 is unfolded, the boss is snapped into the groove at one end of the slide groove, such that the support bar 200, the support piece 220, and the connection piece 210 are fixed as a triangle, and the support bar will not shake, thereby ensuring the stability of the foldable bed frame.

Referring to FIG. 1 to FIG. 10, when the support bar 200 is folded, the top surface and the bottom surface of the support bar do not go beyond the top surface and the bottom surface of the first bed frame body, namely the width L1 of the support bar 200 is smaller than or equal to the height L2 of the first reference side frame.

Referring to FIG. 1 to FIG. 10, the foldable bed frame includes two frame bodies 100 and two frame bodies 110, and when folded, all folded support legs are retracted inside the bed frame, such that the overall folded bed frame takes up a small volume to facilitate storage and transport.

Embodiment 2

Figure 12:
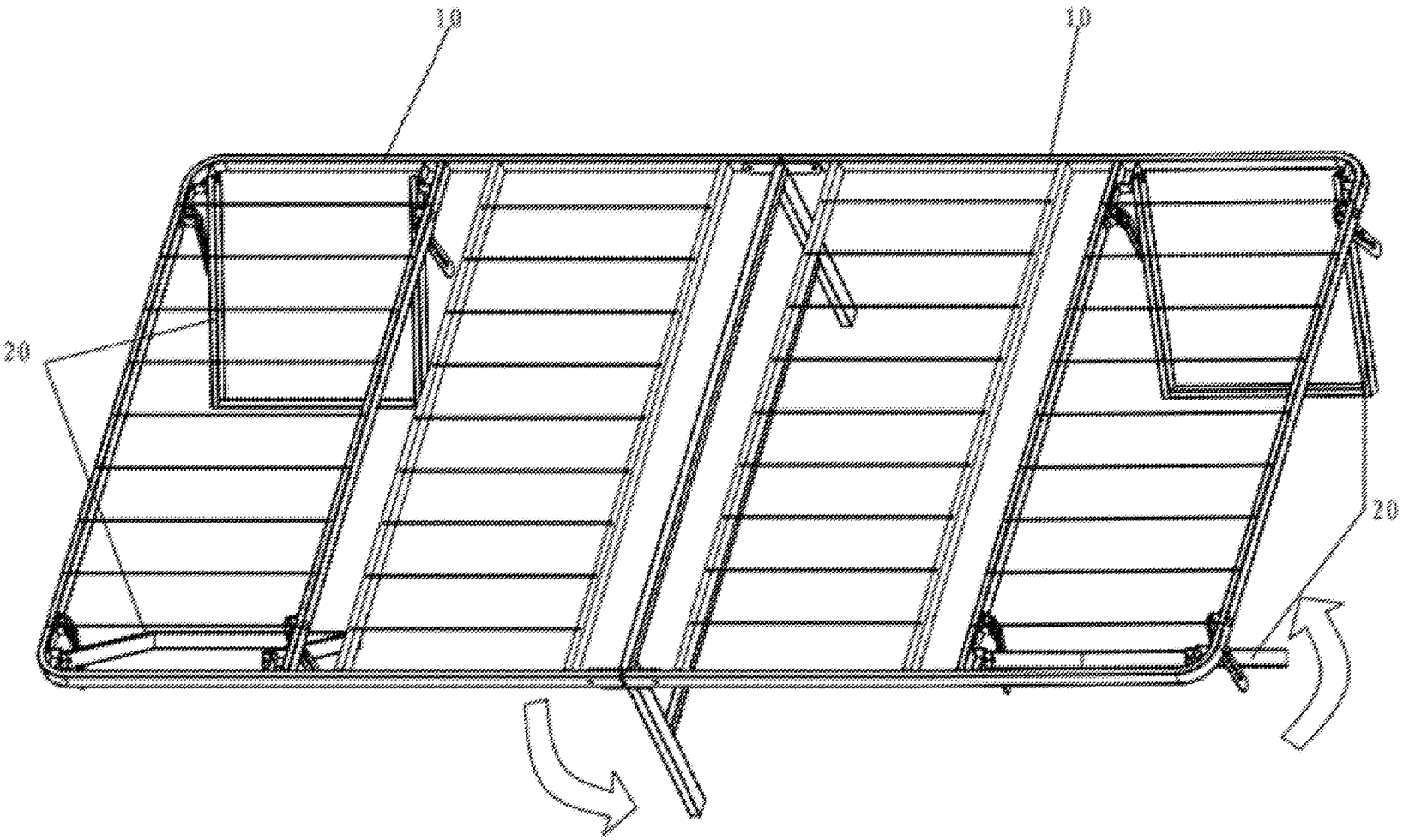
FIG. 12 is a schematic diagram of the folding direction of support legs of the foldable bed frame in accordance with the second embodiment of the present disclosure.

Referring to FIG. 11 to FIG. 12, the difference between Embodiment 2 and Embodiment 1 lies in that the foldable bed frame in Embodiment 1 has 4 bed frame bodies, while the foldable bed frame in Embodiment 2 has 2 unit bed frame each with only one frame body, the folding steps for Embodiment 1 can be found in FIG. 1 to FIG. 10, while the folding steps for Embodiment 2 are just as follows: the first support legs 20 are folded, and then the two unit bed frames 10 are folded over to complete the folding.

The description above only lists embodiments of the present utility model, which are not used to limit the scope of the present utility model. Equivalent substitutions, such as variations and modifications, made by those skilled in the art without departing from the spirit and scope of the present utility model shall be encompassed by the scope of the present utility model.

What is claimed:

1. A foldable bed frame comprising:

a pair of unit bed frames arranged symmetrically with respect to each other and pivotally connected to each other such that each unit bed frame is foldable in a first direction, wherein each unit bed frame comprises:

a generally U-shaped exterior frame comprising a first longitudinal bar, a second longitudinal bar, and an exterior lateral bar in between the first and second longitudinal bars and connected with or formed with the first and second longitudinal bars; and an interior lateral bar spaced apart from the exterior lateral bar, and having a first end coupled with the first longitudinal bar and a second end coupled with the second longitudinal bar; and a plurality of first support legs, each comprising a first support bar and a second support bar, wherein of each respective first support leg in the plurality of first support legs, an upper end of the first support bar is pivotally connected with the exterior lateral bar of a corresponding unit bed frame at a side facing the interior lateral bar of the corresponding unit bed frame; and an upper end of the second support bar is pivotally connected with the interior lateral bar of the corresponding unit bed frame at a side facing the exterior lateral bar of the corresponding unit bed frame;

wherein the respective first support leg is foldable in a second direction that is different from the first direction in which the pair of unit bed frames folds, and when folded, the first support bar and the second support bar are contained within a space defined by the exterior lateral bar and the interior lateral bar of the corresponding unit bed frame.

2. The foldable bed frame according to claim 1, wherein the second direction is orthogonal to the first direction.

3. The foldable bed frame according to claim 1, wherein each respective unit bed frame in the pair of unit bed frames comprises:

a first bed frame body; and a second bed frame body, wherein the pair of unit bed frames are pivotally connected to each other through the second frame bodies thereof, and the first bed frame body and the second bed frame body of each respective unit bed frame are pivotally connected to each other, and foldable in the first direction.

4. The foldable bed frame according to claim 3, wherein, when each respective first support leg is folded, the first support bar and the second support bar are contained within a space defined by a top surface and a bottom surface of the first bed frame body of the corresponding unit bed frame.

5. The foldable bed frame accordingly to claim 3, wherein of each respective unit bed frame in the pair of unit bed frames, the first bed frame body comprises the first longitudinal bar, the second longitudinal bar, the exterior lateral bar, and the interior lateral bar.

6. The foldable bed frame according to claim 1, wherein each respective first support leg in the plurality of first support legs further comprises:

a connection bar between the first support bar and the second support bar, wherein the connection bar is connected or formed with the first support bar and the second support bar.

7. The foldable bed frame accordingly to claim 6, wherein of each respective first support leg, the connection bar, the first support bar and the second support bar collectively form a general U-shape.

8. The foldable bed frame accordingly to claim 6, wherein when each respective first support leg is folded, the first support bar, the second support bar and the connection bar are contained within a space defined by the exterior lateral bar and the interior lateral bar of the corresponding unit bed frame.

9. The foldable bed frame accordingly to claim 1, wherein each respective first support leg in the plurality of first support legs further comprises:

a first connecting piece connected with the exterior lateral bar of the corresponding unit bed frame at the side facing the interior lateral bar of the corresponding unit bed frame, wherein the upper end of the first support bar is pivotally connected with the exterior lateral bar by pivotally connecting to the first connecting piece; and a second connecting piece connected with the interior lateral bar of the corresponding unit bed frame at the side facing the exterior lateral bar of the corresponding unit bed frame, wherein the upper end of the second support bar is pivotally connected with the interior lateral bar by pivotally connecting to the second connecting piece.

10. The foldable bed frame according to claim 9, wherein the first or second support bar is provided with a first boss, a first support piece or a second support piece is provided with a slide groove, and the first boss is configured to be snapped into the slide groove and slide along the slide groove.

11. The foldable bed frame according to claim 9, wherein a first support piece or a second support piece is provided with a boss, the first or second support bar is provided with a slide groove, and the boss is configured to be snapped into the slide groove and slide along the slide groove.

12. The foldable bed frame accordingly to claim 9, wherein each respective first support leg in the plurality of first support legs further comprises:

a first support piece having a first end connected to the first connection piece at the exterior lateral bar, and a second end connected to the first support bar; and a second support piece having a first end connected to the second connection piece at the interior lateral bar, and a second connected to the second support bar.

13. The foldable bed frame accordingly to claim 1, wherein each respective first support leg in the plurality of first support legs further comprises:

a first support piece having a first end connected to the exterior lateral bar, and a second end connected to the first support bar; and a second support piece having a first end connected to the interior lateral bar, and a second connected to the second support bar.

* * * * *